US007013629B2

(12) United States Patent
Burchert et al.

(10) Patent No.: US 7,013,629 B2
(45) Date of Patent: Mar. 21, 2006

(54) OPEN-END SPINNING ROTOR

(75) Inventors: Mathias Burchert, Ostfildern (DE); Bernd Loos, Winzingen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 11/113,981

(22) Filed: Apr. 26, 2005

(65) Prior Publication Data

US 2005/0247041 A1 Nov. 10, 2005

(30) Foreign Application Priority Data

Apr. 26, 2004 (DE) ..... 10 2004 021 356

(51) Int. Cl.
*D01H 4/10* (2006.01)

(52) U.S. Cl. ..... 57/416

(58) Field of Classification Search ..... 57/404–417
See application file for complete search history.

(56) References Cited

U.S. PATENT DOCUMENTS

| | | | | |
|---|---|---|---|---|
| 4,492,077 A * | 1/1985 | Raasch et al. | ..... | 57/414 |
| 5,718,110 A * | 2/1998 | Stahlecker | ..... | 57/416 |
| 5,873,231 A | 2/1999 | Tjin | | |

FOREIGN PATENT DOCUMENTS

| | | |
|---|---|---|
| DE | 43 04 151 A1 | 8/1994 |
| DE | 41 23 255 C2 | 2/1999 |
| DE | 196 30 834 C2 | 7/1999 |

* cited by examiner

*Primary Examiner*—Gary L. Welch
*Assistant Examiner*—Shaun R. Hurley
(74) *Attorney, Agent, or Firm*—Crowell & Moring LLP

(57) ABSTRACT

The hollow interior of an open-end spinning rotor is defined by an inner contour, which comprises a fiber sliding surface and a fiber collecting groove. The front surface of the open-end spinning rotor may have an opening width of between 19 and 23 mm, the fiber sliding surface may have a tapering of a maximum of 10°, and while the diameter of the fiber collecting groove may measure less than 30 mm.

16 Claims, 1 Drawing Sheet

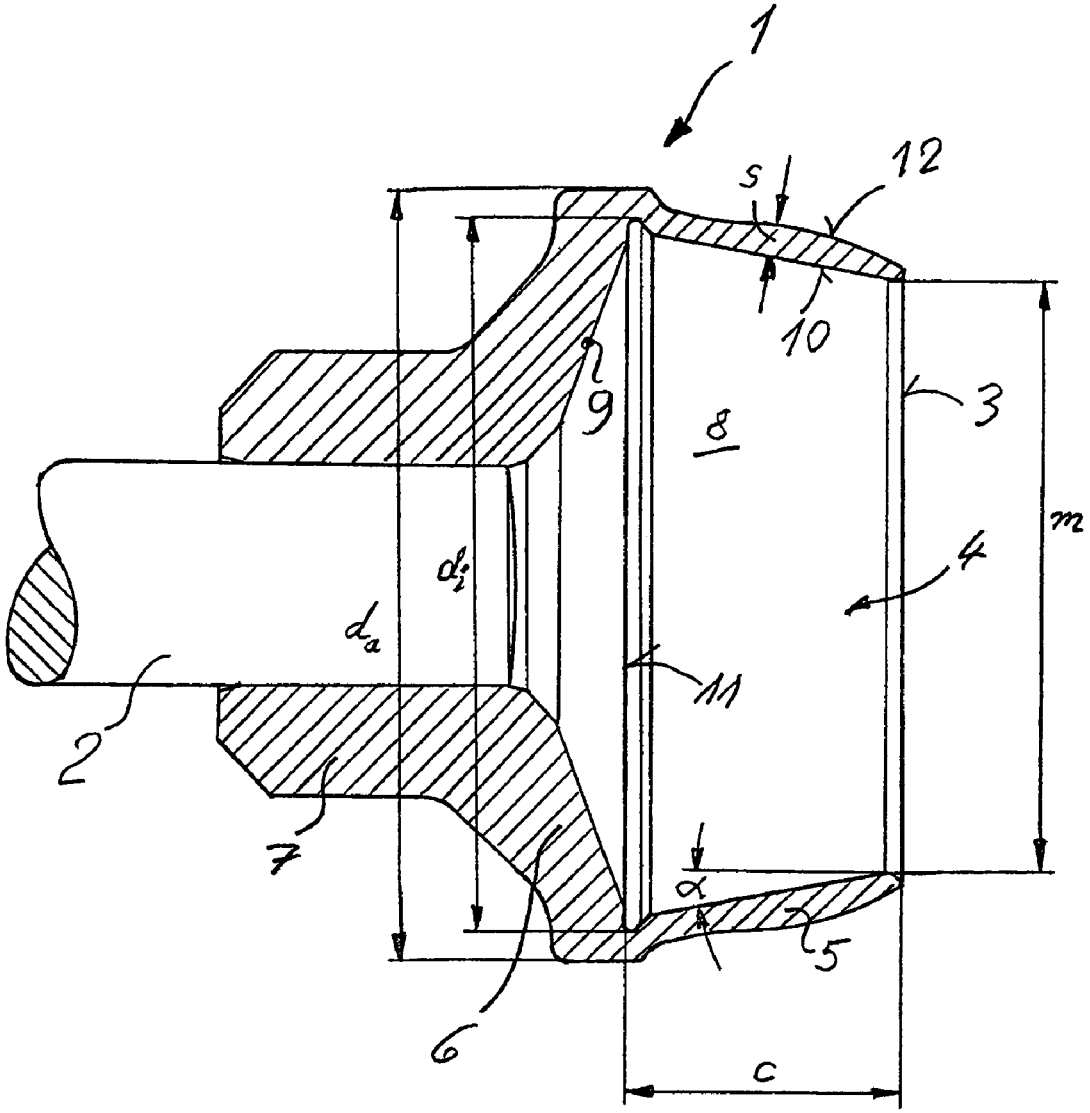
1
12
s
10
9
8
3
m
4
$d_i$
$d_a$
11
2
7
α
5
6
c

OPEN-END SPINNING ROTOR

BACKGROUND AND SUMMARY OF THE INVENTION

This application claims the priority of German Application No. 10 2004 021356.9 filed Apr. 26, 2004, the disclosure of which is expressly incorporated by reference herein.

The present invention relates to an open-end spinning rotor comprising a hollow interior, which is defined by an inner contour, which—starting from an opening width which is formed in the front surface by an opening—passes into a fiber collecting groove via a smooth fiber sliding surface extending conically, which fiber collecting groove has the largest diameter of the inner contour, which measures less than 30 mm.

An open-end spinning rotor of this embodiment is prior art in German published patent 41 23 255. Required speeds today for open-end spinning rotors presently exceed 150,000 rpm. For this reason, the dimensions of the open-end spinning rotors are designed as small as possible. However, the width of the opening located in the front surface must still permit the insertion of a component into the hollow interior, which component comprises the mouth of a fiber feed channel and the initial part of a yarn withdrawal channel, as a rule in the form of a yarn withdrawal nozzle. With the reduction of the dimensions of the open-end spinning rotor, practical operating limits are approached.

It is an object of the present invention to further optimize an open-end spinning rotor of the above mentioned type and to make it applicable for speeds which could reach 180,000 rpm.

This object has been achieved in accordance with the present invention in that—with an opening width of less than 24 mm—the tapering of the fiber sliding surface measures a maximum of 10°.

The aim of a compromise of this kind is to try and achieve the largest possible opening width with the smallest possible diameter of the fiber collecting groove, which is only possible when the degree of tapering of the fiber sliding surface is kept as low as possible. The tapering angle of the fiber sliding surface should only be so big that the single fibers which are fed to the fiber sliding surface can just about slide into the fiber collecting groove.

Lower taperings of the fiber sliding surface are known in non-generic open-end spinning rotors. In German published patent 196 30 834, an open-end spinning rotor is disclosed in which the degree of tapering of the fiber sliding surface to the rotational axis measures only between 8° and 12°. However, the aim here is to permit the thread formation to take place already on the fiber sliding surface, that is, a sliding of the fibers into a fiber collecting groove arranged downstream does not take place in this case.

Furthermore, in German published patent application 43 04 151, FIG. 20, a totally cylindrical fiber sliding surface is even disclosed. This, however, is provided with a particular surface structure, which exerts a mechanical transporting effect on the fed in single fibers, which is designed to replace the missing centrifugal forces.

In contrast, however, and in accordance with the present invention, a normal sliding of the single fibers on the fiber sliding surface as a result of the centrifugal forces, and without any additional surface structures, should take place.

The diameter of the fiber collecting groove should preferably measure a maximum of 26.5 mm and may even measure only 24 mm. The ratio of the diameter of the fiber collecting groove to the opening width should be between 1.05 and 1.22. In order to ensure that the single fibers reach the fiber collecting groove, the fiber collecting groove is arranged at a distance from the front surface which measures only between 9 and 12 mm.

In order to reach high speeds, it is further provided that in the area of the fiber collecting groove also the outer diameter should measure a maximum of 28 mm. The wall thickness in the area of the fiber sliding surface is, at 1 mm, kept very thin. Despite these small dimensions, a sufficient strength is achieved for the wall of the open-end spinning rotor in that the outer contour in the area of the fiber sliding surface is curved. This curve should run convexly towards the front surface.

Other objects, advantages and novel features of the present invention will become apparent from the following detailed description of the invention when considered in conjunction with the accompanying drawings.

BRIEF DESCRIPTION OF THE DRAWINGS

FIG. 1 shows a longitudinal cross-section view of an open-end spinning rotor in accordance with an embodiment of the present invention.

DETAILED DESCRIPTION

The open-end spinning rotor 1 shown in the drawing is, in the known way, connected to a rotatable shaft 2 in a non-movable way, which shaft 2 is supported and driven in a way not shown. Based on a front surface 3 comprising an opening 4 having an opening width m, the open-end spinning rotor 1 comprises walls one after the other in the form of a side wall 5 and a rotor bottom 6 adjacent thereto, which in turn passes into a collar 7. The latter serves to press the open-end spinning rotor 1 onto the shaft 2.

The hollow interior 8 of the open-end spinning rotor 1 is defined by an inner contour 9, which forms a known smooth fiber sliding surface 10 adjacent to the front surface 3, said fiber sliding surface 10 extending to a fiber collecting groove 11 which has the largest diameter d; of the inner contour 9, and in which fiber collecting groove 11 the single fibers fed during operation are added to and twisted into a spun thread. As can be seen, the fiber sliding surface 10 expands conically towards the fiber collecting groove 11.

The side wall 5 is bordered by an outer contour 12, which, corresponding to the expanding fiber sliding surface 10, also increases in diameter from the front surface 3 to a largest outer diameter da. The latter is located in the area of the fiber collecting groove 11.

During operation of the high-speed rotating open-end spinning rotor 1, single fibers, opened from a sliver, are catapulted against the fiber sliding surface 10 under the action of an air stream in a known way (not shown), from where they slide into the fiber collecting groove 11 and are there bound into the spun thread. As in the course of ever higher production speeds, open-end spinning rotors with speeds of up to 180,000 rpm are strived for, the dimensions of the inner contour 9 as well as the outer contour 12 are selected in a way described below. Included is the provision for the outer contour 12 of the side wall 5—in axial section—to be curved in the area of the fiber sliding surface 10, whereby this curve runs convexly in the direction towards the front surface 3.

The diameter d; of the fiber collecting groove 11 should be smaller than 30 mm and preferably only 26.5 mm, perhaps even only 24 mm if required. The outer diameter da arranged thereto should measure in the area of the fiber collecting groove 11 a maximum of 28 mm, if required even only 26 mm.

In order to maintain a sufficiently large opening width m of between 19 and 23 mm, preferably 21.5 mm, in the case of such small diameters d; and da, the tapering a of the fiber sliding surface 10 is chosen at a maximum of 10°. The tapering can, in certain circumstances, measure only 7°, or even 4°, should this be required, when the tapering is so designed that the single fibers can still slide into the fiber collecting groove 11 despite the reduced centrifugal forces caused by the reduced tapering.

The ratio of the diameter d; of the fiber collecting groove 11 to the opening width m lies for the purposes of the present invention between 1.05 and 1.22.

The distance from the fiber collecting groove 11 to the front surface 3 is also very short and lies preferably between 9 and 12 mm.

Due to the special curved outer contour 12, it is possible to limit the wall thickness s in the area of the fiber sliding surface 10 to approximately one millimetre.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Open-end spinning rotor, comprising:

a rotor body, including an inner contour defining a hollow interior, an opening to the hollow interior at a front surface of the rotor, and a fiber collecting groove, wherein the inner contour extends between the opening and the fiber collecting groove, forming a smooth fiber sliding surface extending conically into the fiber collecting groove, a width of the opening is less than 24 mm, the largest diameter of the inner contour is less than 30 mm, and the fiber sliding surface tapers from the opening to the largest diameter of the inner contour at a maximum of 10° from a longitudinal axis of the rotor.

2. Open-end spinning rotor according to claim 1, wherein the opening width is between 19 mm and 23 mm.

3. Open-end spinning rotor according to claim 1, wherein a diameter of the fiber collecting groove is a maximum of 26.6 mm.

4. Open-end spinning rotor according to claim 2, wherein a diameter of the fiber collecting groove is a maximum of 26.6 mm.

5. Open-end spinning rotor according to claim 3, wherein a ratio of the diameter of the fiber collecting groove to the opening width is between 1.05 and 1.22.

6. Open-end spinning rotor according to claim 4, wherein a ratio of the diameter of the fiber collecting groove to the opening width is between 1.05 and 1.22.

7. Open-end spinning rotor according to claim 1, wherein a distance from the fiber collecting groove to the front surface is between 9 mm and 12 mm.

8. Open-end spinning rotor according to claim 3, wherein a distance from the fiber collecting groove to the front surface is between 9 mm and 12 mm.

9. Open-end spinning rotor according to claim 5, wherein a distance from the fiber collecting groove to the front surface is between 9 mm and 12 mm.

10. Open-end spinning rotor according to claim 1, wherein an outer diameter of the rotor body is a maximum of 28 mm in an area radially outboard of the fiber collecting groove.

11. Open-end spinning rotor according to claim 3, wherein an outer diameter of the rotor body is a maximum of 28 mm in an area radially outboard of the fiber collecting groove.

12. Open-end spinning rotor according to claim 1, wherein the opening width is approximately 21.5 mm.

13. Open-end spinning rotor according to claim 1, wherein a wall thickness of the rotor body measures approximately one millimeter in an area outboard of the fiber sliding surface.

14. Open-end spinning rotor according to claim 10, wherein a wall thickness of the rotor body measures approximately one millimeter in an area radially outboard of the fiber sliding surface.

15. Open-end spinning rotor according to claim 1, wherein an outer contour of the rotor body is curved in an area radially outboard of the fiber sliding surface.

16. Open-end spinning rotor according to claim 15, wherein the curve runs convexly towards the front surface.

* * * * *